US010537976B2

(12) United States Patent
Nakano et al.

(10) Patent No.: US 10,537,976 B2
(45) Date of Patent: Jan. 21, 2020

(54) FORMER ROTARY DRESSER AND DRESSING METHOD

(71) Applicant: NSK LTD., Tokyo (JP)

(72) Inventors: Susumu Nakano, Otsu (JP); Masashi Yanagisawa, Okazaki (JP); Sadao Sakakibara, Okazaki (JP)

(73) Assignee: NSK LTD., Tokyo (JP)

( * ) Notice: Subject to any disclaimer, the term of this patent is extended or adjusted under 35 U.S.C. 154(b) by 0 days.

(21) Appl. No.: 16/084,792

(22) PCT Filed: Sep. 12, 2017

(86) PCT No.: PCT/JP2017/032801
§ 371 (c)(1),
(2) Date: Sep. 13, 2018

(87) PCT Pub. No.: WO2018/225280
PCT Pub. Date: Dec. 13, 2018

(65) Prior Publication Data

US 2019/0358773 A1 Nov. 28, 2019

(30) Foreign Application Priority Data

Jun. 9, 2017 (JP) ..... 2017-114570

(51) Int. Cl.
*B24B 53/07* (2006.01)
*B24B 53/14* (2006.01)

(52) U.S. Cl.
CPC ..... *B24B 53/07* (2013.01); *B24B 53/14* (2013.01)

(58) Field of Classification Search
CPC ..... B24B 53/06; B24B 53/062; B24B 53/065; B24B 53/07; B24B 53/075; B24B 53/14
See application file for complete search history.

(56) References Cited

U.S. PATENT DOCUMENTS 8,771,043 B2 * 7/2014 Sakakibara ..... B24B 53/14 125/11.03
10,160,095 B2 * 12/2018 Rudolf ..... B24B 53/12
(Continued)

FOREIGN PATENT DOCUMENTS

JP 53-11112 B 4/1978
JP 59-345 B2 1/1984
(Continued)

OTHER PUBLICATIONS

Search Report dated Nov. 7, 2017, issued by the International Searching Authority in International Application No. PCT/JP2017/032801 (PCT/ISA/210).
(Continued)

*Primary Examiner* — Timothy V Eley
(74) *Attorney, Agent, or Firm* — Sughrue Mion, PLLC

(57) ABSTRACT

Provided is a formed rotary dresser that has regions in which diamond abrasive grains are scattered and arranged on an outer circumferential surface thereof brought into contact with a grindstone, and slit regions in which the diamond abrasive grains are not arranged on the outer circumferential surface thereof. The plurality of slit regions are provided to be inclined with respect to a rotational axis. A plurality of octahedral diamond abrasive grains are arranged along downstream edges of the slit regions in a rotating direction such that any face of an octahedron is parallel with the outer circumferential surface.

7 Claims, 6 Drawing Sheets

(56) References Cited

U.S. PATENT DOCUMENTS

| | | | | |
|---|---|---|---|---|
| 10,239,184 | B2 * | 3/2019 | Axinte | B24B 53/14 |
| 2012/0108153 | A1 | 5/2012 | Sakakibara et al. | |

FOREIGN PATENT DOCUMENTS

| | | | |
|---|---|---|---|
| JP | 59-1555 | B2 | 1/1984 |
| JP | 2012-91292 | A | 5/2012 |

OTHER PUBLICATIONS

Written Opinion dated Nov. 7, 2017, issued by the International Searching Authority in International Application No. PCT/JP2017/032801 (PCT/ISA/237).

* cited by examiner

FORMER ROTARY DRESSER AND DRESSING METHOD

TECHNICAL FIELD

The present invention relates to a formed rotary dresser and a dressing method.

BACKGROUND ART

A diamond dresser is generally used for dressing of a CBN grindstone. In a precision mass-production grinding field of recent years, a dressing frequency increases in terms of high-precision continuous production, and a reduction in a dressing time is also required to reduce a cycle time. As a result, the diamond dresser has been considered to be problematic in that a lifespan is short and time and a cost is increased. Thus, a technique for improving wear resistance of the diamond dresser to prolong the lifespan has been developed. For example, a rotary diamond dresser in which one crystal plane of an octahedral diamond abrasive grain is embedded to be exposed approximately in parallel to an outer circumference of the dresser with the main intention of improving the wear resistance of the diamond dresser is disclosed in Patent Document 1. In addition, a rotary diamond dresser in which any edge of an octahedral diamond abrasive grain is embedded to be exposed approximately in parallel with a relative rotational velocity vector of a grindstone is disclosed in Patent Document 2. Further, a rotary diamond dresser in which a spiral concave groove is buried and diamond abrasive grains are arranged on a surface excluding the groove at a density of no less than 150 grains/cm$^2$ is disclosed in Patent Document 3.

RELATED ART REFERENCE

Patent Document

Patent Document 1: Japanese Examined Patent Application Publication No. S59-345

Patent Document 2: Japanese Examined Patent Application Publication No. S59-1555

Patent Document 3: Japanese Examined Patent Application Publication No. S53-11112

SUMMARY OF THE INVENTION

Problems to be Solved by the Invention

However, when the wear resistance of the rotary dresser is generally improved, there occurs a problem that sharpness of the dresser is reduced. For this reason, in the rotary diamond dressers of Patent Documents 1 and 2, although the improvement of the wear resistance is recognized, a further improvement in sharpness was needed. In a configuration of Patent Document 3, sufficient sharpness may not be obtained under severe conditions, neither mention nor suggestion is given especially with regard to the octahedral diamond abrasive grain, and no contribution is made to an arrangement relation between the octahedral diamond abrasive grain and the concave groove.

The present invention was made in view of the above circumstances, and an object thereof is to provide a formed rotary dresser and a dressing method that make excellent wear resistance compatible with excellent sharpness and has a long lifespan.

Means for Solving the Problems

As described above, the following contents are disclosed herein.

(1) A formed rotary dresser includes regions in which diamond abrasive grains are scattered and arranged on an outer circumferential surface thereof brought into contact with a grindstone, and slit regions in which the diamond abrasive grains are not arranged on the outer circumferential surface thereof, wherein the plurality of slit regions are provided to be inclined with respect to a rotational axis, and a plurality of octahedral diamond abrasive grains are arranged along downstream edges of the slit regions in a rotating direction such that any face of an octahedron is parallel with the outer circumferential surface.

According to the formed rotary dresser, the plurality of slit regions in which the diamond abrasive grains are not arranged are provided to be inclined with respect to the rotational axis, and one face of each of the plurality of octahedral diamond abrasive grains arranged along the downstream edges of the slit regions is arranged in parallel with the outer circumferential surface brought into contact with the grindstone. Thereby, the grindstone is dressed by hardest diamond crystal planes of the octahedral diamond abrasive grains. For this reason, wear resistance of the formed rotary dresser is improved, and discharge of come-out abrasive grains is accelerated by a coolant supplied to the slit regions, so that sharpness of the formed rotary dresser can be maintained over a long period.

(2) The formed rotary dresser according to (1), wherein the octahedral diamond abrasive grains arranged along the edges at approximately equal intervals, and in a pair of slit regions adjacent to each other in the rotating direction, a row of the octahedral diamond abrasive grains in one of the slit regions and a row of the octahedral diamond abrasive grains in the other slit region are arranged with the octahedral diamond abrasive grains are mutually shifted in a direction of the rotational axis.

According to the formed rotary dresser, an entire surface of the grindstone can be dressed with high shape transcription precision by a small number of octahedral diamond abrasive grains.

(3) The formed rotary dresser according to (1) or (2), wherein the diamond abrasive grains are arranged on the outer circumferential surface in a spiral shape, and are arranged at approximately equal intervals.

According to the formed rotary dresser, since the diamond abrasive grains are arranged on the outer circumferential surface in the spiral shape, a load loaded on the grindstone at the time of dressing is reduced, so that the generation of vibration can be prevented.

(4) The formed rotary dresser according to any one of (1) to (3), wherein the diamond abrasive grains are arranged to be shifted from each other at upstream and downstream sides of the rotating direction in the direction of the rotational axis.

According to the formed rotary dresser, the entire surface of the grindstone can be dressed with high precision.

(5) The formed rotary dresser according to any one of (1) to (4), wherein the diamond abrasive grains includes the octahedral diamond abrasive grains, and diamond abrasive grains having a different shape from the octahedral diamond abrasive grains.

According to the formed rotary dresser, since the octahedral diamond abrasive grains are configured to be provided only in specified regions, production man-hours and material costs of the dresser are inhibited while maintaining desired working precision.

(6) A dressing method includes dressing a grindstone using a formed rotary dresser including regions in which diamond abrasive grains are scattered and arranged on an outer circumferential surface thereof brought into contact with a grindstone, and slit regions in which the diamond abrasive grains are not arranged on the outer circumferential surface thereof, and in which the plurality of slit regions are provided to be inclined with respect to a rotational axis, and a plurality of octahedral diamond abrasive grains are arranged along downstream edges of the slit regions in a rotating direction such that any face of an octahedron is parallel with the outer circumferential surface.

According to the dressing method, since the grindstone is dressed by hardest diamond crystal planes of the octahedral diamond abrasive grains, the wear resistance of the formed rotary dresser is improved, and the discharge of the come-out abrasive grains is accelerated by a coolant supplied to the slit regions, so that the sharpness of the formed rotary dresser can be maintained over a long period.

(7) The dressing method according to (6), wherein the diamond abrasive grains includes the octahedral diamond abrasive grains, and diamond abrasive grains having a different shape from the octahedral diamond abrasive grains.

According to the dressing method, the formed rotary dresser in which the octahedral diamond abrasive grains are provided only in specified regions is used, so that running costs of the dresser can also be reduced while maintaining working precision.

Advantages of the Invention

According to the present invention, the formed rotary dresser can reconcile excellent wear resistance and excellent sharpness to make a lifespan longer.

MODES FOR CARRYING OUT THE INVENTION

Hereinafter, an embodiment of the present invention will be described in detail with reference to the drawings.

A case in which a formed rotary dresser of the present invention dresses a grindstone that grinds a raceway surface in a raceway of a ball bearing will be described herein by way of example, but the formed rotary dresser is not limited to this application. In the following description, "dressing" refers to including "turning."

Figure 1B:
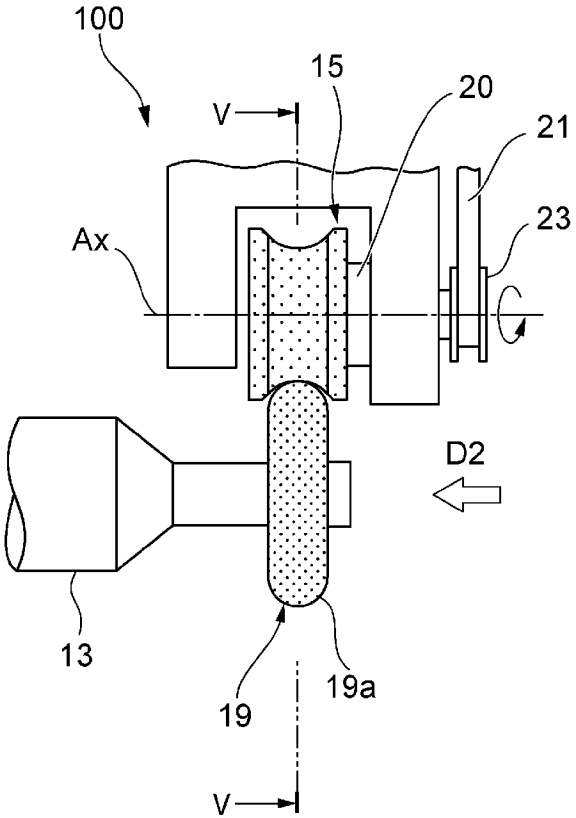
FIG. 1B is a schematic partial configuration view illustrating a dressing position of the grinding device.
Figure 1A:
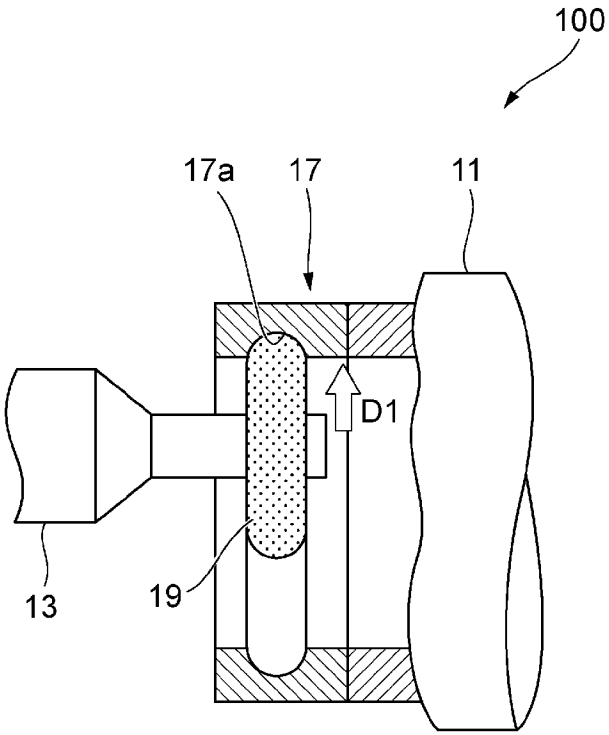
FIG. 1A is a schematic partial configuration view illustrating a working position of a grinding device.

FIG. 1A is a schematic partial configuration view illustrating a working position of a grinding device 100, and FIG. 1B is a schematic partial configuration view illustrating a dressing position of the grinding device 100.

The grinding device 100 includes a chuck 11, a grindstone 19, a quill 13 that is driven to move and rotate the grindstone 19, and a formed rotary dresser 15 that dresses the grindstone 19. In the grinding device 100 of this configuration, a case in which a raceway surface of an outer race of the ball bearing is ground by the grindstone 19 is shown.

A ball bearing outer race 17 that is a workpiece is mounted on the chuck 11, and the chuck 11 is driven to rotate the ball bearing outer race 17 at the working position illustrated in FIG. 1A. The quill 13 is configured to rotatably journal the grindstone 19 for groove working and to enable the grindstone 19 to move to the working position and the dressing position based on the formed rotary dresser 15 illustrated in FIG. 1B.

The formed rotary dresser 15 has a rotational axis Ax parallel with a rotational axis of the grindstone 19, and is journalled at a position at which it can be brought into contact with a grinding surface 19*a* of the grindstone 19. A support shaft 20 of the formed rotary dresser 15 is driven to rotate via a pulley 23 by a driving belt 21 connected to a drive source (not shown). In addition, the formed rotary dresser 15 may be configured to be driven to rotate in various driving modes such as a mode in which it is directly driven by a motor, a mode in which it is driven via gears, and so on.

The grindstone 19 disposed at the working position illustrated in FIG. 1A is given a cutting depth D1 toward the ball bearing outer race 17 in a radial direction while being rotated by drive of the quill 13, and grinds a raceway surface 17*a* of the ball bearing outer race 17. Thereby, a shape of an outer circumferential surface of the grindstone 19 is transcribed into the raceway surface 17*a*. After the grinding is completed, the grindstone 19 is evacuated, and the wrought ball bearing outer race 17 is dismounted from the chuck 11. The next ball bearing outer race is mounted on the chuck 11, and the grinding of the raceway surface is performed again.

After the grinding is performed a predetermined number of times, the grindstone 19 is displaced to the dressing position based on the formed rotary dresser 15 in a direction of an arrow D2 by the drive of the quill 13 as illustrated in FIG. 1B. Then, the grindstone 19 is displaced toward the formed rotary dresser 15 in a radial direction. Then, the outer circumferential surface of the grindstone 19 is brought into contact with an outer circumferential surface of the formed rotary dresser 15, and the grindstone 19 is dressed while being rotated along with the formed rotary dresser 15. Rotating directions of the formed rotary dresser 15 and the grindstone 19 may be the identical directions or the opposite directions. Rotational speeds or the like of the formed rotary dresser 15 and the grindstone 19 are appropriately selected depending on conditions.

Figure 2:
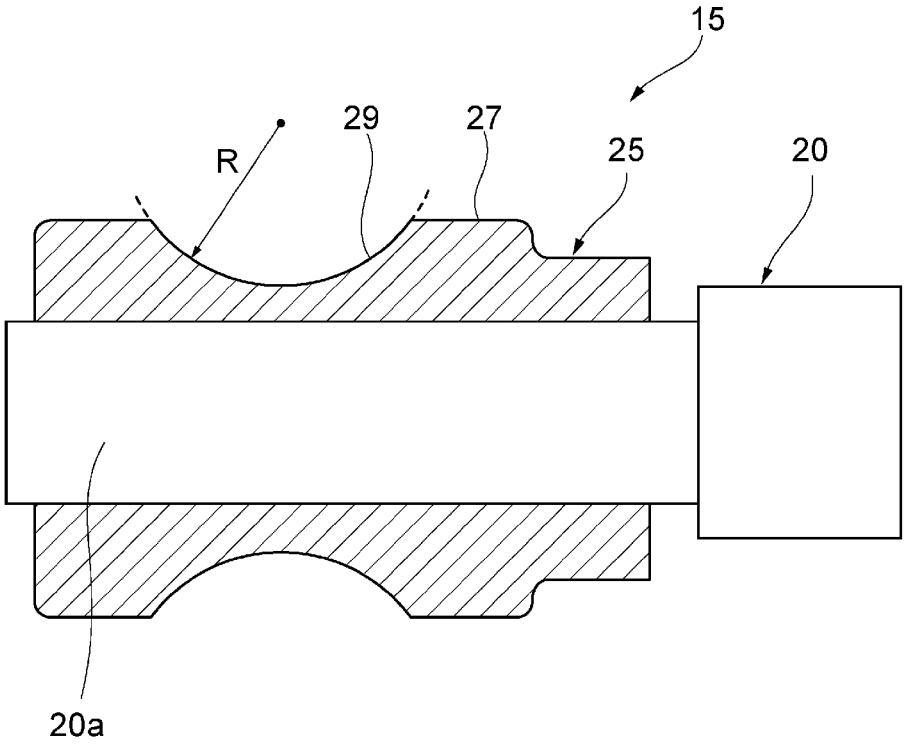
FIG. 2 is a partial sectional view of a formed rotary dresser.

FIG. 2 is a partial sectional view of the formed rotary dresser 15.

The formed rotary dresser 15 has the support shaft 20 and a sintered metal part 25 made of tungsten carbide (WC). The sintered metal part 25 is provided on an outer circumference of a mandrel 20*a* of the support shaft 20, and a groove portion 29 having a radius R of curvature is formed in the middle of a large diameter portion 27 in an axial direction throughout a circumference thereof.

Numerous abrasive grains made of a diamond are embedded in at least a surface of the groove portion 29 of the sintered metal part 25, that is, in the outer circumferential surface of the formed rotary dresser 15 which is brought into contact with the grindstone 19 (see FIGS. 1A and 1B). The abrasive grains are buried in an outer surface of the sintered metal part 25 before the sintered metal part 25 is sintered, and are consolidated by sintering. Shapes of the abrasive grains are adjusted by machining a surface of the sintered metal part 25 after the sintering as needed.

Figure 3:
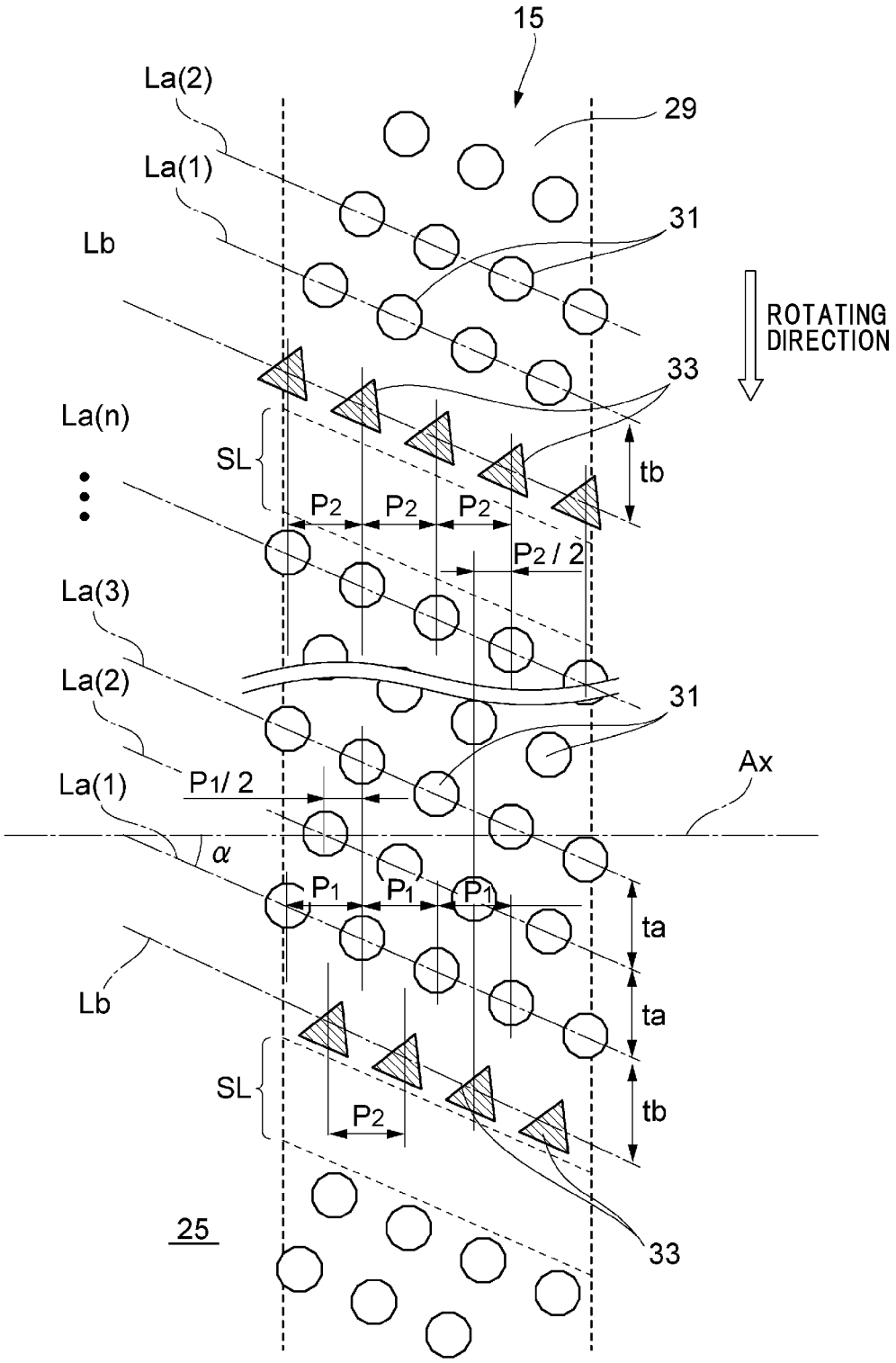
FIG. 3 is a schematic top development view of a groove portion of a sintered metal part on which abrasive grains are arranged.

FIG. 3 is a schematic top development view of the groove portion 29 of the sintered metal part 25 in which the abrasive grains are arranged. An arrangement pitch or an arranging direction of the abrasive grains illustrated in FIG. 3 is an example, and the formed rotary dresser 15 of this configuration is not limited to this arrangement pattern.

The abrasive grains include numerous common diamond abrasive grains 31 and octahedral diamond abrasive grains 33 (octahedron diamonds, hereinafter referred to as octahedral diamond abrasive grains) having an octahedral structure. Hereinafter, the diamond abrasive grains 31 and the octahedral diamond abrasive grains 33 will be described in distinction from each other. That is, the octahedral diamond abrasive grains 33 shall not be included in the diamond abrasive grains 31.

The diamond abrasive grains 31 are diamond abrasive grains that are widely generally used, such as synthetic diamonds or metal coating synthetic diamonds that are used for a diamond tool or the like.

Figure 4:
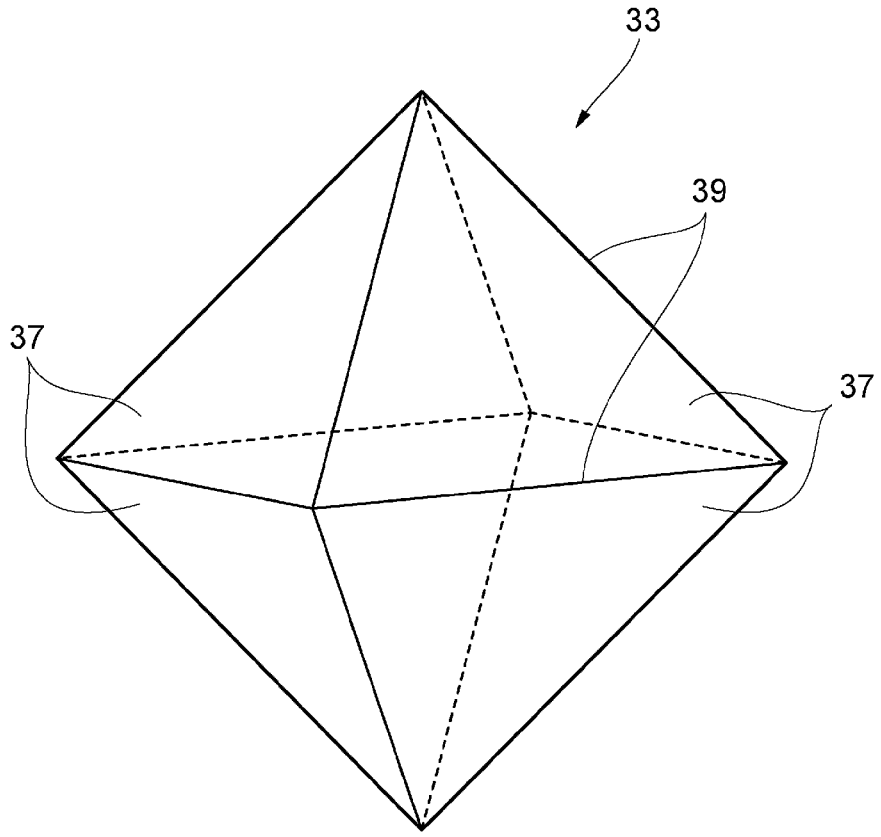
FIG. 4 is a perspective view of an octahedral diamond abrasive grain.

As illustrated in FIG. 4, the octahedral diamond abrasive grains 33 are octahedral diamonds that are different from the common diamond abrasive grains 31. Each of the octahedral diamond abrasive grains 33 is a diamond that has eight equilateral-triangular faces 37 that are hardest among diamond crystal planes becoming (111) planes. Directions parallel to edges 39 in an octahedron are hardest directions.

In the arrangement pattern of the abrasive grains illustrated in FIG. 3, the diamond abrasive grains 31 and the octahedral diamond abrasive grains 33 are scattered and arranged on the outer circumferential surface of the sintered metal part 25. In regions in which the diamond abrasive grains 31 are arranged, the diamond abrasive grains 31 are arranged on an oblique line La(1), which is inclined with respect to the rotational axis Ax of the formed rotary dresser 15 at an angle $\alpha$, at approximately equal intervals with a pitch P1 in a direction of the rotational axis Ax.

In the arrangement of the diamond abrasive grains 31 along the oblique line La(1), a plurality of rows similarly provided at intervals to in a rotating direction. That is, the plurality of diamond abrasive grains 31 are mutually arranged at equal intervals along the oblique lines La(1) to La(n) (n is the integer). The oblique lines La(1) to La(n) have a spiral shape in which, in the top development view of the outer circumferential surface of the sintered metal part 25 illustrated in FIG. 3, a plurality of sets of spirals are arranged side by side. The diamond abrasive grains 31 are arranged in the spiral shape, so that a load loaded on the grindstone 19 at the time of dressing can be reduced, and an anti-vibration effect is obtained.

The diamond abrasive grains 31 on the oblique lines that are adjacent to each other in a rotating direction among the plurality of oblique lines La(1) to La(n) are arranged with the pitches P1 in the direction of the rotational axis shifted from each other (in the shown example, a shift of ½ of the pitch P1 is shown as an example). Thereby, a pitch of the practical arrangement of the diamond abrasive grains 31 at the time of dressing can be smaller than the pitch P1 of one row. Therefore, precision of the shape transcription can be improved, and the grindstone after the transcription enables grinding of a stable curve shape.

Further, a plurality of slit regions SL in which the diamond abrasive grains 31 and the octahedral diamond abrasive grains 33 are not arranged are provided on the outer circumferential surface of the formed rotary dresser 15 in parallel with the oblique lines La(1) to La(n) in the rotating direction. The slit regions SL are provided at a predetermined slit width in the rotating direction. These slit regions SL may be simply provided on the outer circumferential surface on which the diamond abrasive grains 31 and the octahedral diamond abrasive grains 33 are not arranged, or may be provided in the groove having a predetermined width and depth.

The plurality of octahedral diamond abrasive grains 33 are provided along a downstream edge of each slit region SL in the rotating direction. The octahedral diamond abrasive grains 33 are arranged at approximately equal intervals at a pitch P2, which is almost the same as the pitch P1 of the aforementioned diamond abrasive grains 31, in the direction of the rotational axis Ax. The octahedral diamond abrasive grains 33 are arranged in parallel with an outer circumferential surface on which any one of the eight faces of the octahedron becomes a contact surface with the grindstone 19. The octahedral diamond abrasive grains 33 that are adjacent to each other across the oblique line La(1) to La(n) in the rotating direction are arranged while being shifted from each other in the direction of the rotational axis Ax (in the shown example, a shift of ½ of the pitch P2 is shown as an example).

A row Lb of the octahedral diamond abrasive grains 33 is provided at an interval tb in the rotating direction from the oblique line La(1) that is a row of the diamond abrasive grains 31 arranged downstream from the row Lb in the rotating direction. This interval tb may be approximately the same as or be different from each of the intervals ta for the aforementioned oblique lines La(1) to La(n). As described above, the diamond abrasive grains 31 and the octahedral diamond abrasive grains 33 are discretely arranged in abrasive grain arrangement region excluding the slit regions SL within the outer circumferential surface of the formed rotary dresser 15 at an interval therebetween.

Here, amounts of shift between the diamond abrasive grains 31 and between the octahedral diamond abrasive grains 33 in the direction of the rotational axis of each oblique line are individually set according to a material or a shape of the grindstone to be dressed. The angle $\alpha$ in a spiral direction is mainly determined depending on machinability of a targeted dresser. That is, various parameters such as the intervals ta and tb, the pitches P1 and P2, the angle $\alpha$, etc. are set such that a probability (the number of times of contact) that the diamond abrasive grains 31 are brought into contact with the surface of the grindstone at the time of dressing is approximately the same as the octahedral diamond abrasive grains 33 in the direction of the rotational axis. Further, the parameters are set in consideration of machinability, costs, and so on.

Figure 5:
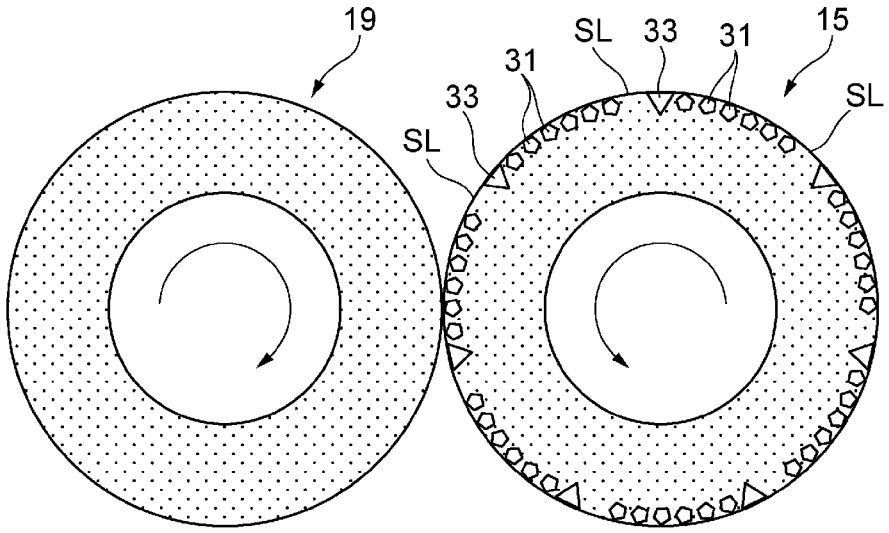
FIG. 5 is a schematic sectional view taken along line V-V of a grindstone and a rotary dresser illustrated in FIG. 1B.

FIG. 5 is a schematic sectional view taken along line V-V of the grindstone 19 and the formed rotary dresser 15 illustrated in FIGS. 1A and 1B.

As described above, the slit regions SL, the octahedral diamond abrasive grains 33, and the diamond abrasive grains 31 are arranged on the outer circumferential surface of the formed rotary dresser 15 which is brought into contact with the grindstone 19 in the opposite rotating direction in this order. Therefore, the slit regions SL, the octahedral diamond abrasive grains 33, and the diamond abrasive grains 31 of the formed rotary dresser 15 are brought into contact with the grindstone 19 in this order. Such a relation is the same at any position of the direction of the rotational axis.

Figure 6:
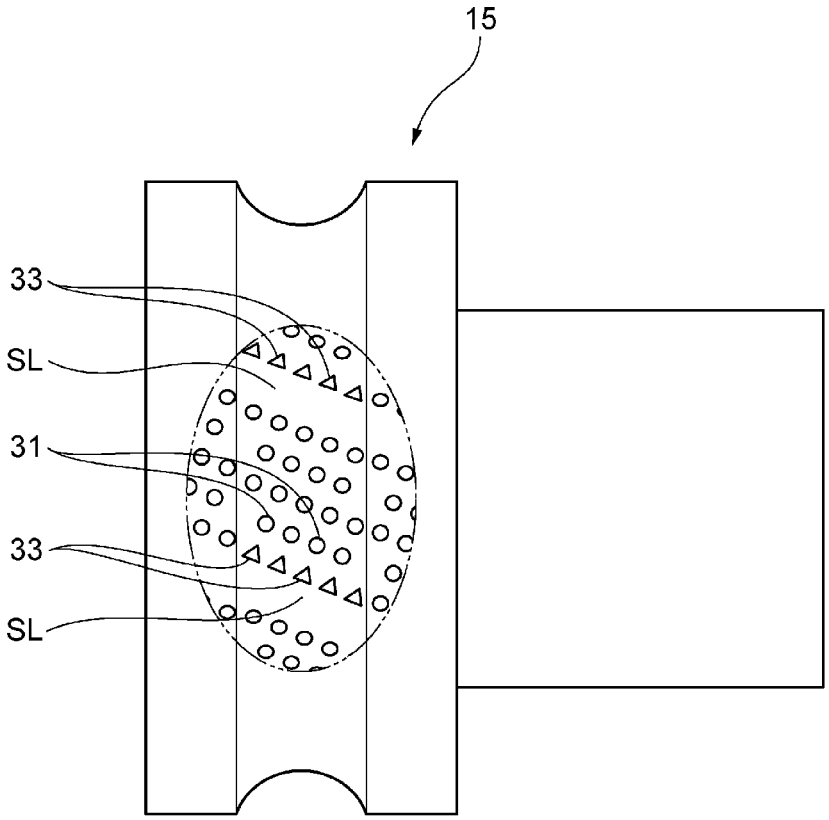
FIG. 6 is a schematic perspective view illustrating an example of the formed rotary dresser.

FIG. 6 is a schematic exterior view illustrating an example of the formed rotary dresser having the above configuration. The formed rotary dresser 15 has the abrasive grain arrangement regions in which the numerous diamond abrasive grains 31 and the numerous octahedral diamond abrasive grains 33 are scattered and arranged, and the slit regions SL in which the abrasive grains 31 and 33 are not arranged. The octahedral diamond abrasive grains 33 are arranged on the downstream edges of the slit regions SL in the rotating direction. The common diamond abrasive grains 31 are arranged in the abrasive grain arrangement regions other than the abrasive grain arrangement regions of the octahedral diamond abrasive grains 33.

The hardest equilateral triangular faces 37 (see FIG. 4) of each octahedral diamond abrasive grain 33 are arranged in parallel with the outer circumferential surface of the formed rotary dresser 15 such that the rotating direction of the formed rotary dresser 15 becomes a direction with high wear resistance. One edge 39 of each octahedral diamond abrasive grain 33 may be arranged in parallel with each slit region SL. According to this arrangement, since the octahedral diamond abrasive grains 33 can be arranged close to the slit regions SL, many diamond abrasive grains can be arranged in spite of a dresser having a small diameter. Since the grindstone is dressed by the hardest diamond crystal planes of the octahedral diamond abrasive grains 33, the wear resistance of the formed rotary dresser 15 is improved and the lifespan is prolonged.

The slit regions SL are arranged upstream from the octahedral diamond abrasive grains 33 in the rotating direction, supply of a coolant to a dressing point can be accelerated. Along with this, the abrasive grains coming out by dressing are discharged from the slit regions SL, and then the octahedral diamond abrasive grains 33 can be brought into contact with the grindstone. For this reason, the octahedral diamond abrasive grains 33 can dress the grindstone without being affected by unnecessary substances such as come-out abrasive grains. Further, the diamond abrasive grains 31 are brought into contact with the grindstone to dress the grindstone afterward. Accordingly, an ideal dressing process in which the surface of the grindstone is roughly mashed and formed by the octahedral diamond abrasive grains 33 first, and then the surface of the grindstone is precisely finished and formed by the diamond abrasive grains 31 can be realized.

As described above, the diamond abrasive grains 31 and the octahedral diamond abrasive grains 33 are spirally arranged, so that dressing resistance can be reduced and dressing precision can be improved. Both the diamond abrasive grains 31 and the octahedral diamond abrasive grains 33 are used, so that the wear resistance can be improved. In this case, a reduction in sharpness due to the combined use of the abrasive grains is avoided by providing the slit regions SL. The octahedral diamond abrasive grains 33 are arranged only in specified regions (downstream edges of the slit regions SL in the rotating direction) of the surface of the formed rotary dresser 15. Thereby, in comparison with a case in which the octahedral diamond abrasive grains 33 are arranged in all the abrasive grain arrangement regions on the surface of the dresser, production man-hours and material costs of the dresser are inhibited while maintaining desired working precision. In addition, running costs of the dressing can also be reduced. Thereby, the formed rotary dresser in which dressing performance is compatible with the wear resistance and the sharpness, the vibration is reduced, and long-lifespan and high-precision dressing can be performed can be realized.

The present invention is not limited to the above embodiment, the configurations of the embodiment are mutually combined, or modified or applied by those skilled in the art on the basis of the mention of the specification and a well-known technique, which is expected in the present invention and is included in the scope for protection.

EXAMPLES

Here, a lifespan test of a rotary dresser was performed on test conditions shown in Table 1 using the formed rotary dresser illustrated in FIG. 6 or a diamond rotary dresser for a common CBN grindstone which had neither the octahedral diamond abrasive grains nor the slit regions SL as a conventional product.

TABLE 1

<Test conditions>

| Grinding conditions | Unit | Setting value |
|---|---|---|
| Grindstone size | [mm] | ϕ27.0 × 5.8 × 6 |
| Maximum dimension | [mm] | ϕ26.7 |
| Minimum dimension | [mm] | ϕ19.5 |
| Dressing cutting amount | [μm × times] | 1 × 20 |
| Dressing speed | [μm/s] | 30 |
| Dressing S.O | [sec] | 0.5 |
| Skip 1 | [pieces/dressing] | 400 |
| Skip 2 | [pieces/dressing] | 300 |
| Skip 3 | [pieces/dressing] | 200 |
| Skip 4 | [pieces/dressing] | 150 |

As shown in Table 1, a new grindstone having a diameter of 27.0 mm was prepared. This grindstone was dressed and adjusted to a maximum dimension. After a workpiece was ground, dressing was performed 20 times per 1 μm (40 μm that is a diameter per dressing). When a diameter of the grindstone reached a minimum dimension, this was set to a lifespan of the grindstone. Dressing spark-out (dressing S.O) that was a holding time of a state in which a cutting operation was completed was set to 0.5 sec.

A difference (7.2 mm) between the maximum dimension and the minimum dimension was divided into four equal parts (1.8 mm), and skip 1 (26.7 mm to 24.9 mm), a skip 2 (24.9 mm to 23.1 mm), a skip 3 (23.1 mm to 21.3 mm), and a skip 4 (21.3 mm to 19.5 mm) were set. That is, since the diameter of the dresser was reduced to 40 μm by dressing once, one skip was terminated (40 μm×45=1.8 mm) by dressing 45 times.

The number of produced workpieces after the dressing was set to 400 pieces for skip 1, 300 pieces for skip 2, 200 pieces for skip 3, and 150 pieces for skip 4.

Here, when the workpiece was ground by the dressed grindstone, the grindstone was not correctly formed when the dresser was worn, and a workpiece shape (a groove shape, a groove dimension) deviated from an allowable range. Therefore, the workpiece shape of the produced workpiece was measured. When the workpiece shape did not enter the allowable range even after the dressing, this was set to a lifespan of the formed rotary dresser.

The above test results are shown in Tables 2 and 3.

TABLE 2

| No. | Number of produced pieces (×1000 pieces) |
|---|---|
| 1 | 143 |
| 2 | 557 |
| 3 | 457 |
| 4 | 391 |
| 5 | 675 |
| Average | 445 |

TABLE 3

| No. | Number of produced pieces (×1000 pieces) |
|---|---|
| 1 | 196 |
| 2 | 229 |
| 3 | 384 |
| 4 | 467 |
| 5 | 436 |
| 6 | 116 |
| 7 | 326 |
| 8 | 167 |
| 9 | 279 |
| Average | 289 |

In the formed rotary dresser of the present embodiment, as shown in Table 2, the number of produced workpieces until the formed rotary dresser reached the lifespan was 445,000 that was an average value in test results of five times. In contrast, in a formed rotary dresser of a conventional product, an average value in test results of nine times was 289,000. It can be confirmed that the lifespan of the formed rotary dresser of the present invention is about 1.5 times longer.

This application is based on Japanese Patent Application No. 2017-114570, filed on Jun. 9, 2017, the content of which is incorporated herein by reference.

DESCRIPTION OF REFERENCE NUMERALS AND SIGNS

15: Formed rotary dresser
19: Grindstone
31: Diamond abrasive grain
33: Octahedral diamond abrasive grain (octahedral diamond abrasive grain)
Ax: Rotational axis
SL: Slit region
P1: Pitch of diamond abrasive grains
P2: Pitch of octahedral diamond abrasive grains

The invention claimed is:

1. A formed rotary dresser comprising regions in which diamond abrasive grains are scattered and arranged on an outer circumferential surface thereof brought into contact with a grindstone, and slit regions in which the diamond abrasive grains are not arranged on the outer circumferential surface thereof, wherein the plurality of slit regions are provided to be inclined with respect to a rotational axis of the dresser, and a plurality of octahedral diamond abrasive grains are arranged along downstream edges of the slit regions in a rotating direction of the dresser such that any face of an octahedron is parallel with the outer circumferential surface.

2. The formed rotary dresser according to claim 1, wherein:

the octahedral diamond abrasive grains are arranged along the edges at approximately equal intervals; and in a pair of slit regions adjacent to each other in the rotating direction, a row of the octahedral diamond abrasive grains in one of the slit regions and a row of the octahedral diamond abrasive grains in the other slit region are arranged with the octahedral diamond abrasive grains mutually shifted in a direction of the rotational axis.

3. The formed rotary dresser according to claim 1, wherein the diamond abrasive grains are arranged on the outer circumferential surface in a spiral shape, and are arranged at approximately equal intervals.

4. The formed rotary dresser according to claim 1, wherein the diamond abrasive grains are arranged to be shifted from each other at upstream and downstream sides of the rotating direction in a direction of the rotational axis.

5. The formed rotary dresser according to claim 1, wherein the diamond abrasive grains includes the octahedral diamond abrasive grains, and diamond abrasive grains having a different shape from the octahedral diamond abrasive grains.

6. A dressing method for dressing a grindstone, using a formed rotary dresser which includes regions in which diamond abrasive grains are scattered and arranged on an outer circumferential surface thereof brought into contact with a grindstone, and slit regions in which the diamond abrasive grains are not arranged on the outer circumferential surface thereof, and in which the plurality of slit regions are provided to be inclined with respect to a rotational axis of the dresser, and a plurality of octahedral diamond abrasive grains are arranged along downstream edges of the slit regions in a rotating direction of the dresser such that any face of an octahedron is parallel with the outer circumferential surface.

7. The dressing method according to claim 6, wherein the diamond abrasive grains includes the octahedral diamond abrasive grains, and diamond abrasive grains having a different shape from the octahedral diamond abrasive grains.

* * * * *